US011837836B2

(12) United States Patent
Zhao et al.

(10) Patent No.: US 11,837,836 B2
(45) Date of Patent: Dec. 5, 2023

(54) METHOD OF MAKING ELECTRICAL CONNECTOR HAVING UPPER AND LOWER CONTACTS FROM A FIRST CARRIER AND TWO DISCRETE MIDDLE SHIELDING PLATES FROM A SECOND CARRIER

(71) Applicants: FUYU ELECTRONICAL TECHNOLOGY (HUAIAN) CO., LTD., Huai'an (CN); FOXCONN INTERCONNECT TECHNOLOGY LIMITED, Grand Cayman (KY)

(72) Inventors: Jun Zhao, Huaian (CN); Cai-Yun Zhang, Huaian (CN)

(73) Assignees: Fuyu Electronic Technology (Huai'an) Co., Ltd., Huai'an (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/583,434

(22) Filed: Jan. 25, 2022

(65) Prior Publication Data

US 2022/0255278 A1 Aug. 11, 2022

(30) Foreign Application Priority Data

Feb. 6, 2021 (CN) ..... 202110175663.7

(51) Int. Cl.
*H01R 43/24* (2006.01)
*H01R 13/6581* (2011.01)

(52) U.S. Cl.
CPC ..... *H01R 43/24* (2013.01); *H01R 13/6581* (2013.01)

(58) Field of Classification Search
CPC ..... H01R 43/24; H01R 13/6581
USPC ..... 439/736
See application file for complete search history.

(56) References Cited

U.S. PATENT DOCUMENTS 9,484,676 B2 * 11/2016 Chuang ..... H01R 13/405
9,755,336 B2 * 9/2017 Cheng ..... H01R 12/712
9,806,476 B2 * 10/2017 Long ..... H01R 13/641
10,044,125 B2 * 8/2018 Qiu ..... H01R 24/60
(Continued)

FOREIGN PATENT DOCUMENTS

CN 203339361 U * 12/2013
CN 203707440 U * 7/2014
(Continued)

*Primary Examiner* — Peter G Leigh
(74) *Attorney, Agent, or Firm* — Ming Chieh Chang

(57) ABSTRACT

A method of making an electrical connector which includes an insulative housing having a tongue with an upper and lower surfaces, a plurality of contacts having respective contacting portions exposed to the upper and lower surfaces of the tongue and having two outermost upper or lower contacts, and a shielding member situated between the upper and lower surfaces of the tongue and overlapping the two outermost upper or lower contacts along a vertical direction perpendicular to the upper and lower surfaces of the tongue is characterized by the steps of: forming the plurality of contacts from a first carrier; forming the shielding member from a second carrier to have the two discrete shielding plates; stacking the first carrier and the second carrier; and molding the plurality of contacts and the two discrete shielding plates with an insulator in one shot.

5 Claims, 12 Drawing Sheets

(56) References Cited

U.S. PATENT DOCUMENTS

| | | | | |
|---|---|---|---|---|
| 10,063,014 | B2 * | 8/2018 | Wen | H01R 24/60 |
| 10,135,196 | B2 * | 11/2018 | Wen | H01R 24/62 |
| 10,135,204 | B2 * | 11/2018 | Zhang | H01R 43/24 |
| 10,236,599 | B2 * | 3/2019 | Zhao | H01R 4/027 |
| 10,756,488 | B2 * | 8/2020 | Tsai | H01R 13/642 |
| 2017/0141495 | A1 * | 5/2017 | Cheng | H01R 13/6273 |
| 2018/0366879 | A1 * | 12/2018 | Zhou | H01R 13/04 |
| 2019/0229456 | A1 * | 7/2019 | Zhao | H01R 13/504 |
| 2019/0252830 | A1 * | 8/2019 | Zhao | H01R 43/16 |
| 2020/0136291 | A1 | 4/2020 | Zhao et al. | |
| 2020/0136293 | A1 | 4/2020 | Zhao | |
| 2020/0212642 | A1 | 7/2020 | Zhao et al. | |
| 2021/0288424 | A1 | 9/2021 | Zhao et al. | |

FOREIGN PATENT DOCUMENTS

| | | | | | |
|---|---|---|---|---|---|
| CN | 104103932 | A | * | 10/2014 | |
| CN | 104112968 | B | * | 7/2016 | H01R 13/5227 |
| CN | 107240821 | A | * | 10/2017 | H01R 13/655 |
| CN | 108808416 | A | * | 11/2018 | |
| CN | 109301566 | A | | 2/2019 | |
| CN | 108134227 | B | * | 6/2020 | H01R 13/02 |
| CN | 111682391 | A | * | 9/2020 | H01R 43/16 |
| CN | 111969353 | A | * | 11/2020 | H01R 13/405 |

* cited by examiner

METHOD OF MAKING ELECTRICAL CONNECTOR HAVING UPPER AND LOWER CONTACTS FROM A FIRST CARRIER AND TWO DISCRETE MIDDLE SHIELDING PLATES FROM A SECOND CARRIER

BACKGROUND OF THE INVENTION

1. Field of the Invention

The present invention relates to an electrical connector including an insulative housing and a plurality of contacts and a shielding member both molded with the insulative housing in one shot.

2. Description of Related Arts

China Patent No. 109301566 discloses a method of making an electrical connector which includes an insulative housing having a tongue with an upper and lower surfaces, a plurality of contacts having respective contacting portions exposed to the upper and lower surfaces of the tongue and having two outermost upper or lower contacts, and a shielding member situated between the upper and lower surfaces of the tongue and overlapping the two outermost upper or lower contacts along a vertical direction perpendicular to the upper and lower surfaces of the tongue, characterized by the step of firstly fixing the two discrete shielding plates to corresponding contacts, e.g., by soldering and then molding on one shot the plurality of contacts and the two discrete shielding plates with an insulator to form the insulative housing.

SUMMARY OF THE INVENTION

A method of making an electrical connector which includes an insulative housing having a tongue with an upper and lower surfaces, a plurality of contacts having respective contacting portions exposed to the upper and lower surfaces of the tongue and having two outermost upper or lower contacts, and a shielding member situated between the upper and lower surfaces of the tongue and overlapping the two outermost upper or lower contacts along a vertical direction perpendicular to the upper and lower surfaces of the tongue is characterized by the steps of: forming the plurality of contacts from a first carrier; forming the shielding member from a second carrier to have the two discrete shielding plates; stacking the first carrier and the second carrier; and molding the plurality of contacts and the two discrete shielding plates with an insulator in one shot.

DETAILED DESCRIPTION OF THE PREFERRED EMBODIMENT

Figure 1:
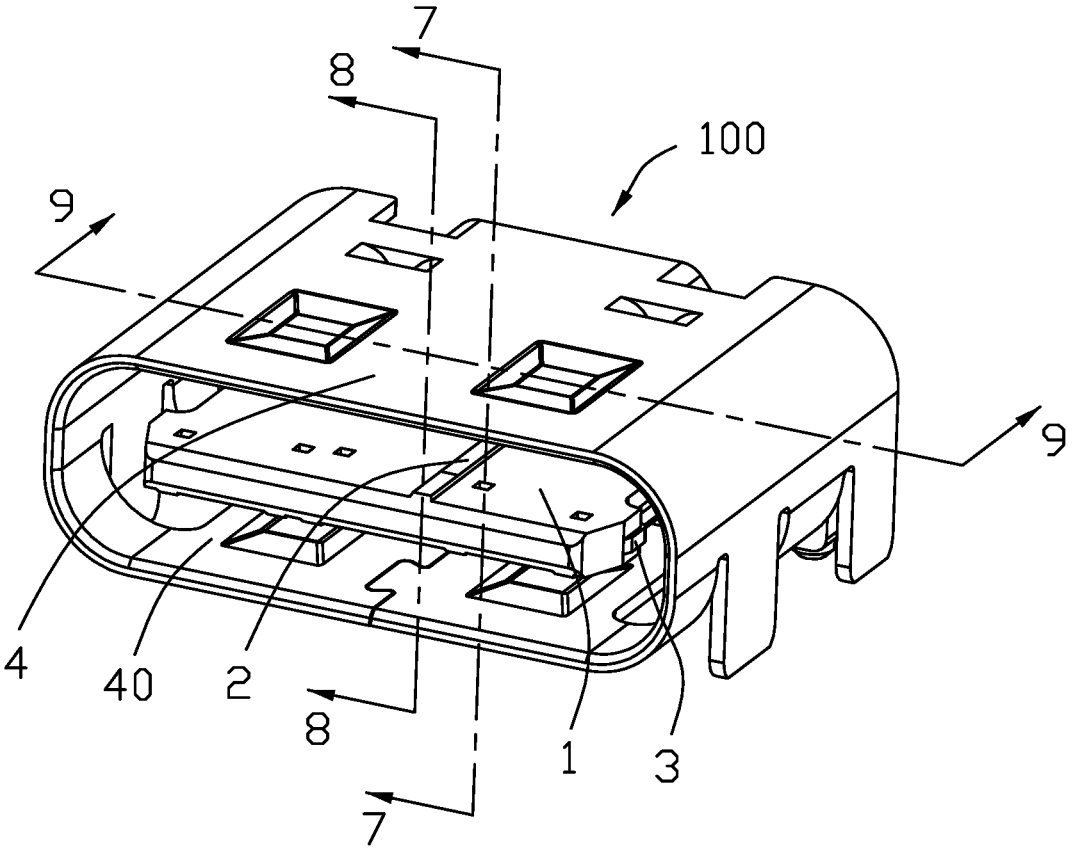
FIG. 1 is a top perspective view of an electrical connector in accordance with the present invention.
Figure 2:
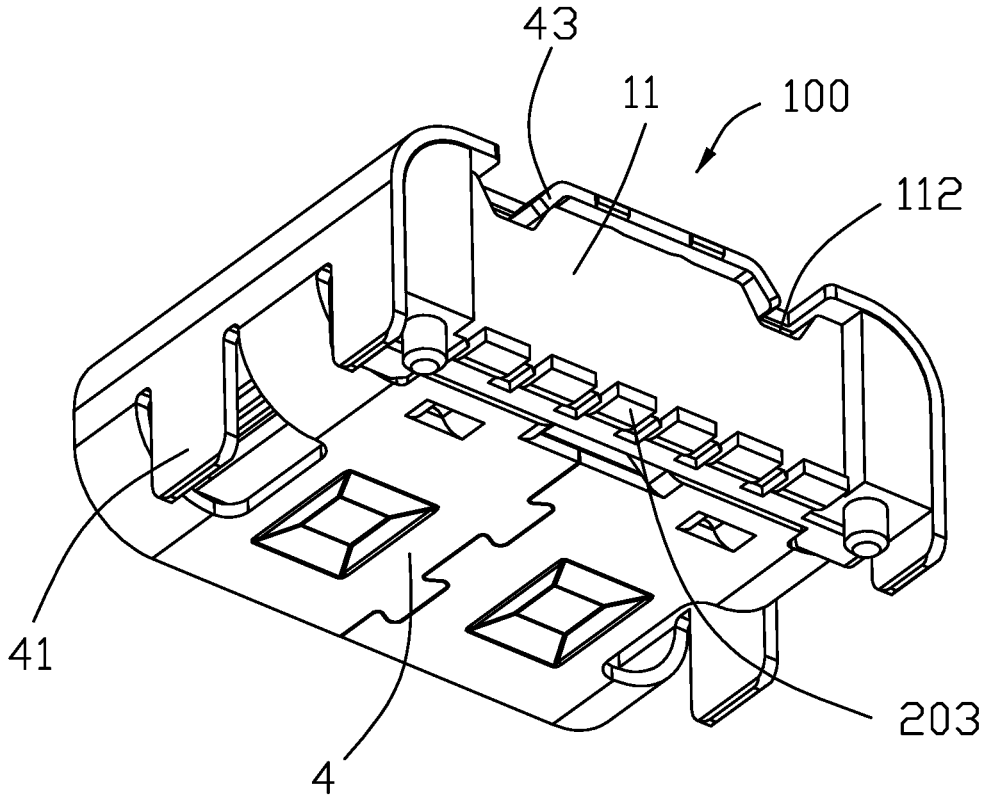
FIG. 2 is a bottom perspective view of the electrical connector.
Figure 3:
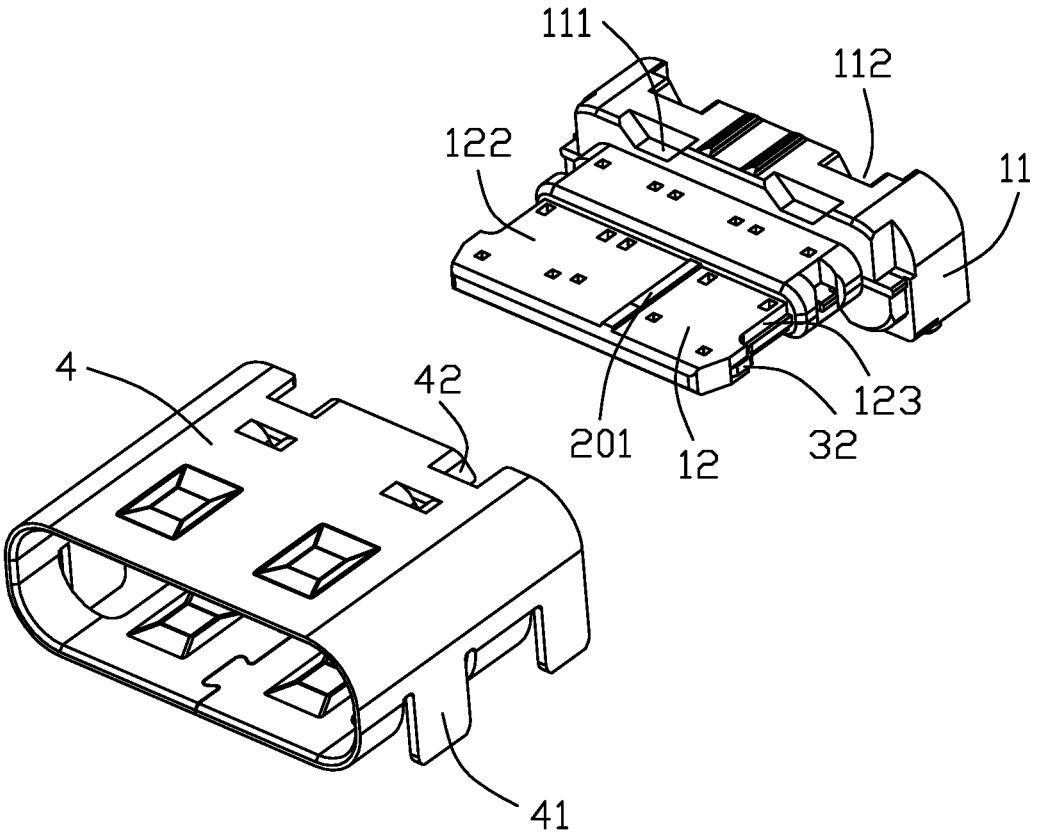
FIG. 3 is a top exploded view of the electrical connector.
Figure 4:
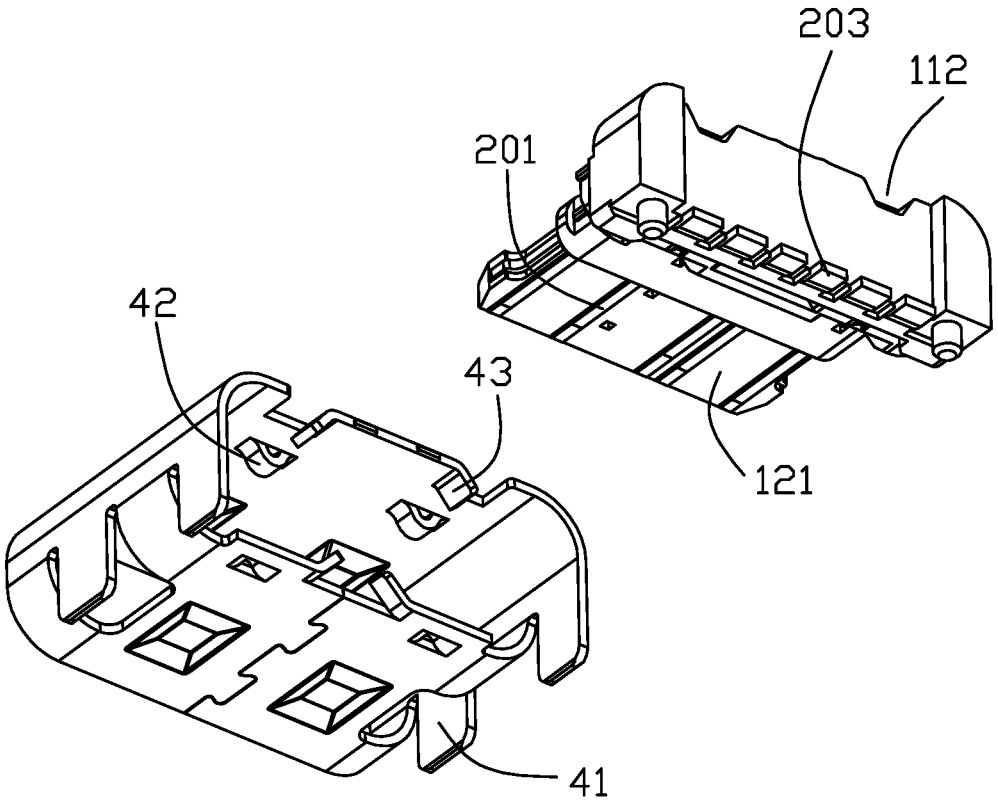
FIG. 4 is a bottom exploded view of the electrical connector.
Figure 5:
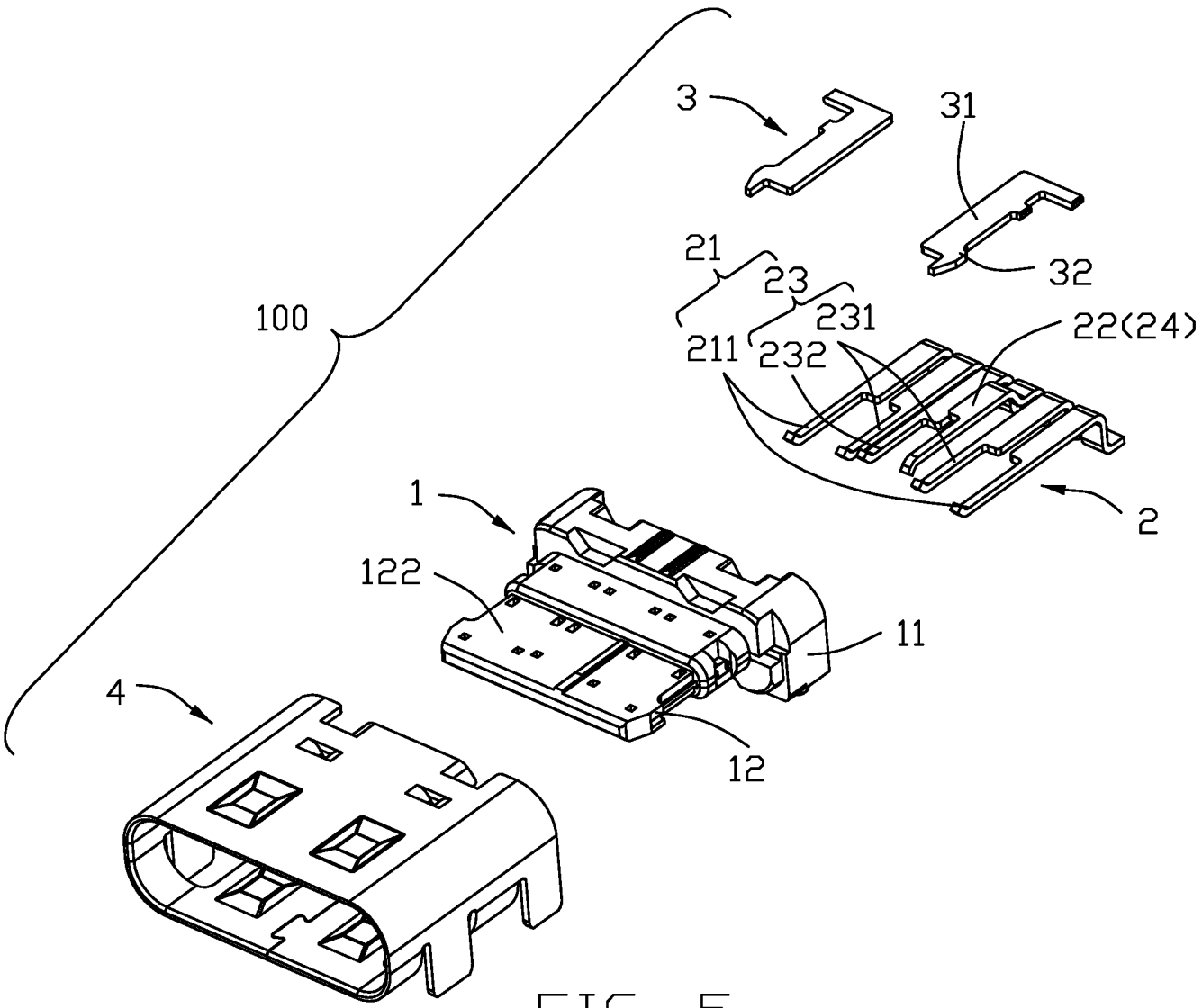
FIG. 5 is a further exploded view of the electrical connector in FIG. 3.
Figure 6:
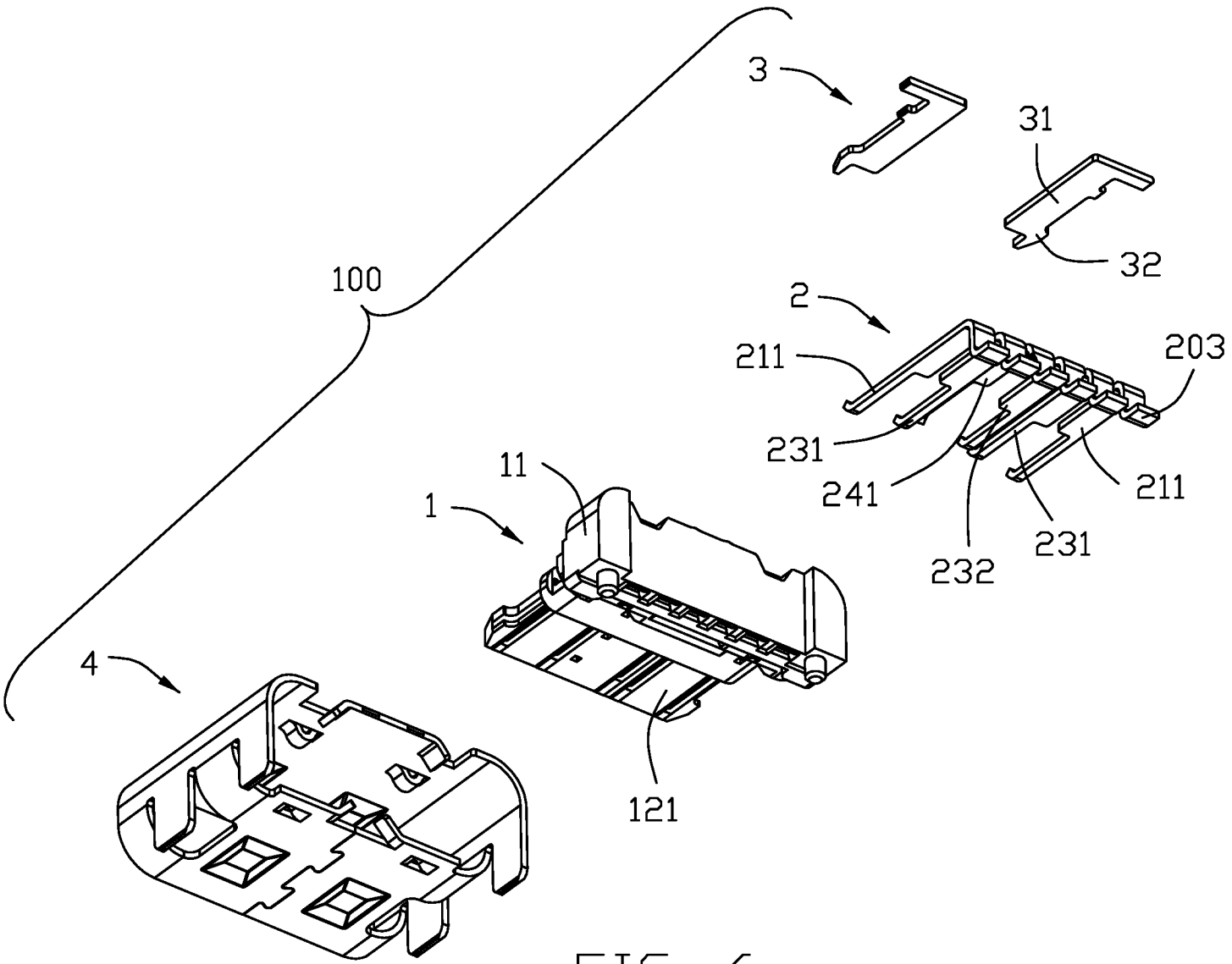
FIG. 6 is a further exploded view of the electrical connector in FIG. 4.
Figure 7:
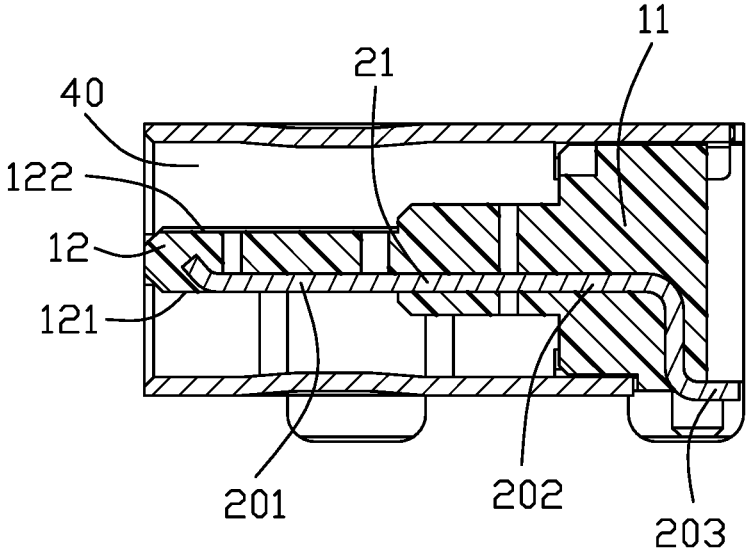
FIG. 7 is a cross-sectional view of the electrical connector taken along line A-A in FIG. 1.
Figure 8:
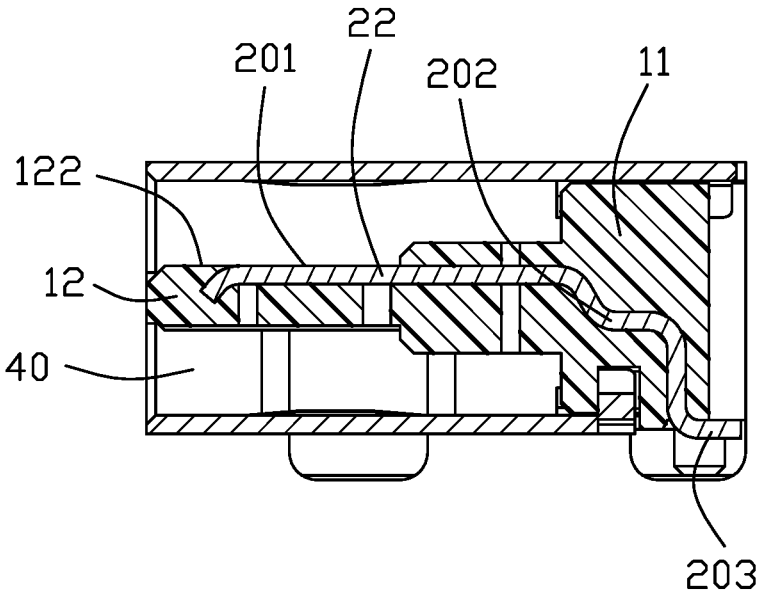
FIG. 8 is a cross-sectional view of the electrical connector taken along line B-B in FIG. 1.
Figure 9:
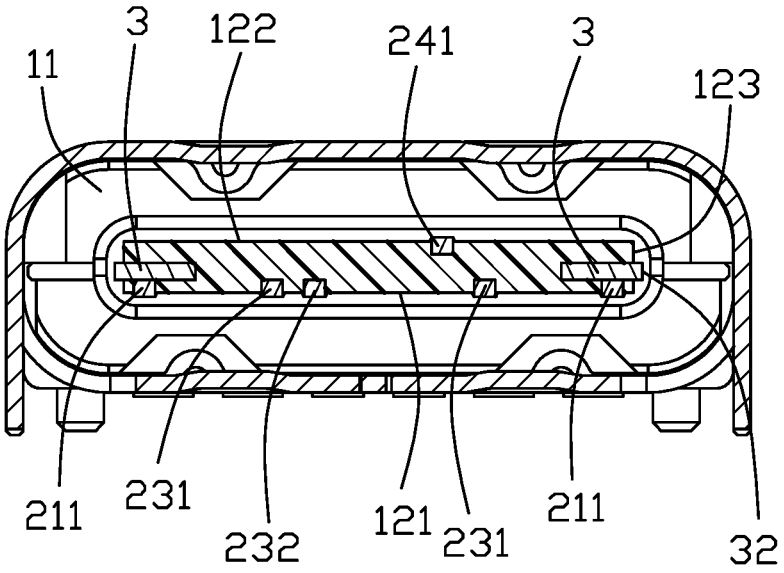
FIG. 9 is a cross-sectional view of the electrical connector taken along line C-C in FIG. 1.

Referring to FIGS. 1-9, an electrical connector 100 in accordance with the present invention is embodied as a USB Type C receptacle connector and comprises an insulative housing 1, a plurality of contacts 2 secured to the insulative housing 1 and including a first row of contacts 21 and a second row of contacts 22, and two discrete shielding plates 3. The electrical connector 100 may further comprise a shielding shell 4 enclosing the insulative housing 1 to form a mating chamber 40.

The insulative housing 1 has a base 11 and a frontal tongue 12. Each of the plurality of contacts has a front contacting portion 201, a widened securing portion 202 wider than the front contacting portion 201, and a widened rear soldering portion 203 wider than the front contacting portion 201. The shielding shell 4 has a pair of legs 41. The base 11 has a pair of first recesses 111 and a pair of second recesses 112; the shielding shell 4 has a pair of first stops 42 and a pair of second stops 43. The tongue 12 has a first surface 121 and a second surface 122 exposing the contacting portions 201 of the first and second rows of contacts 21 and 22, respectively, and a pair of side surfaces 123. Each of the two discrete shielding plates 3 has a main body 31 embedded in the insulative housing 1 and a latching portion 32 exposed to the side surface 123.

The first row of contacts 21 includes two outermost ground contacts 211 and one or more other contacts 23 therebetween; the second row of contacts 22 includes one or more contacts 24 inwardly of the two outermost ground contacts 211. Specifically, in this embodiment, the one or more contacts 23 include two power contacts 231 each adjacent to a corresponding ground contact 211 and one channel contact 232 between the two power contacts 231; the one or more contacts 24 has only one channel contact 241. As is well known in this art, to support dual orientation mating, there are a total of twelve reversely-symmetrically arranged contact positions one through twelve for each surface 121 or 122. Namely, the two outermost ground contacts 211 occupy contact positions one and twelve, the two power contacts 231 occupy contact positions four and nine, the channel contact 232 occupies contact position five; channel contact 241 occupies contact position five at the second surface 22.

Figure 10:
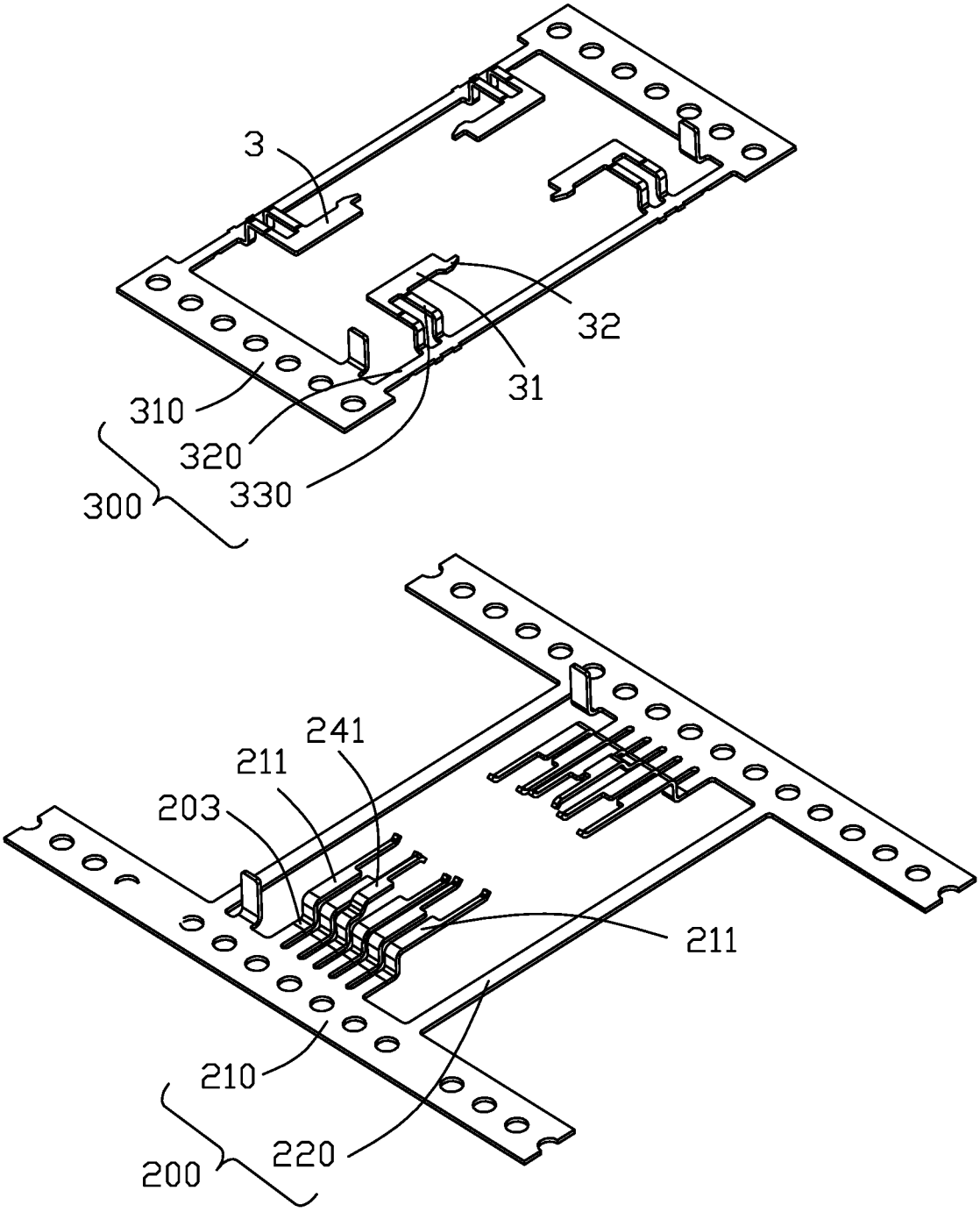
FIG. 10 shows a first carrier formed with plural contacts and a second carrier formed with plural shielding plates of the electrical connector.
Figure 11:
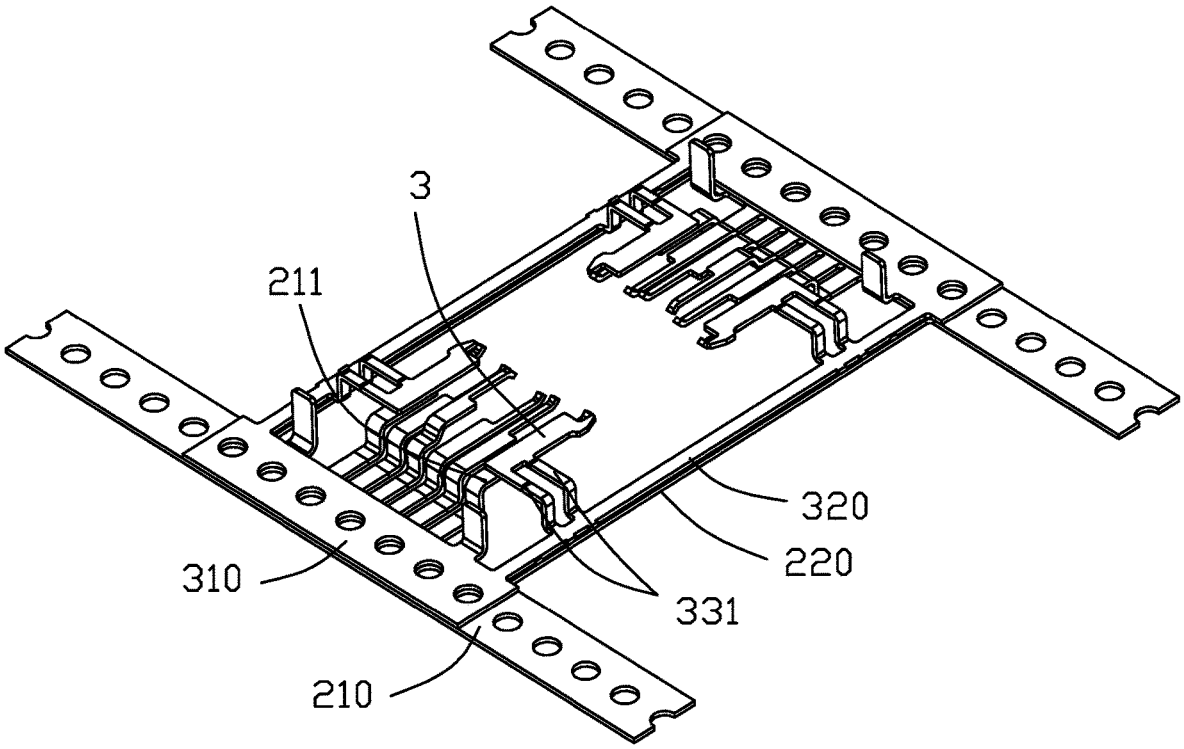
FIG. 11 shows the first carrier and the second carrier are stacked together.
Figure 12:
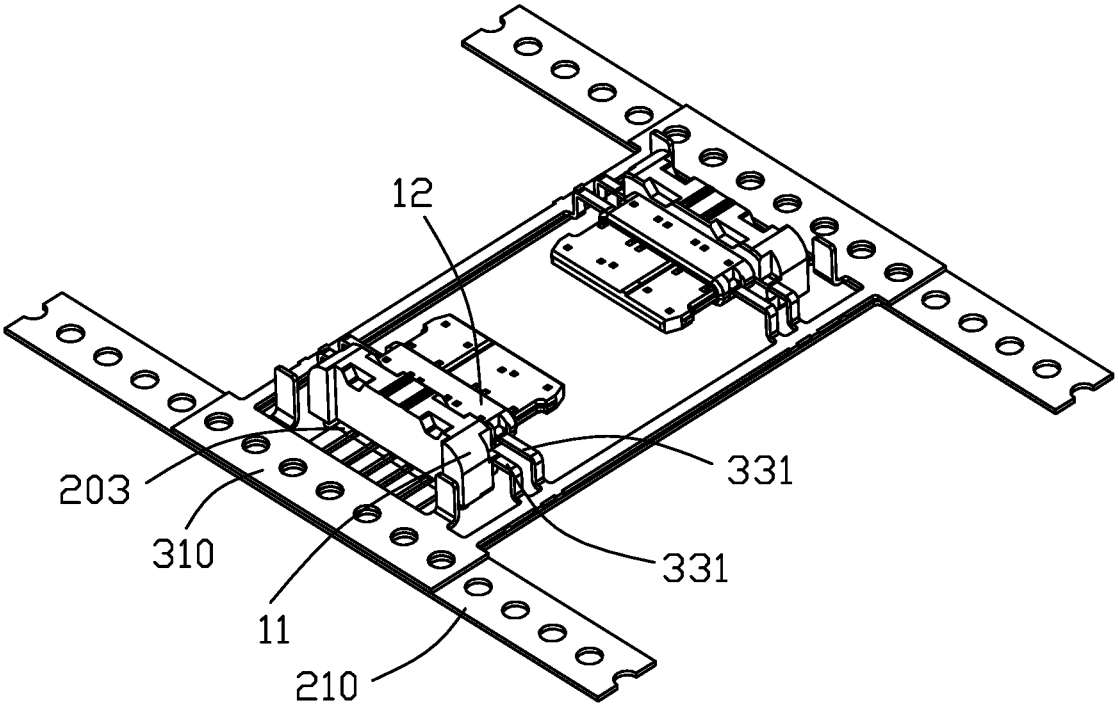
FIG. 12 shows corresponding contacts and shielding plates are molded with an insulative housing of the electrical connector.

Referring to FIGS. 10-11, intermediate product shows that the first and second rows of contacts 21 and 22 are both connected with a single first carrier 200 and the two discrete shielding plates 3 are both connected with a single second carrier 300. The second carrier 300 is stacked with the first carrier 200 so that the two discrete shielding plates 3 overlap the two outermost contacts 211 along a vertical direction perpendicular to the first and second surfaces 21 and 22 of the tongue 12. For one associated electrical connector, the first carrier 200 has a first part or carrier strip 210 connecting to the soldering portions 203 and a pair of second parts 220; the second carrier 300 has a third part 310, a pair of second parts 320, and a pair of third parts 330 each connected to an associated shielding plate 3. Only the rear soldering portions 203 are connected to the first part or carrier strip 210 while the front contacting portions 201 are not connected to any carrier strip. The third part 330 has two bridges 331 (FIG. 11) for stably connecting with the shielding plate 3. Additionally, the two discrete shielding plates 3 may press against the two outermost contacts 211. These carrier parts are to be severed as appropriate.

A method of making the electrical connector 100 which includes the insulative housing 1 having the tongue 12 with opposite first and second surfaces 21 and 22, the plurality of contacts 2 having respective contacting portions 201 exposed to the first and second surfaces 21 and 22 of the tongue 12 and having two outermost ground contacts 211, and the two discrete shielding plates situated between the first and second surfaces 21 and 22 of the tongue 12 and overlapping the two outermost ground contacts 211 along the vertical direction perpendicular to the first and second surfaces 21 and 22 of the tongue 12 are characterized by the steps of: forming the plurality of contacts 2 from the first carrier 200; forming the two discrete shielding plates from the second carrier 300; stacking the first carrier 200 and the second carrier 300; and molding in one shot the plurality of contacts 2 and the two discrete shielding plates 3 with an insulator to form the insulative housing 1.

What is claimed is:

1. A method of making an electrical connector which includes an insulative housing having a tongue with an upper and lower surfaces, a plurality of contacts having respective contacting portions exposed to the upper and lower surfaces of the tongue and having two outermost upper or lower contacts, and a shielding member situated between the upper and lower surfaces of the tongue and overlapping the two outermost upper or lower contacts along a vertical direction perpendicular to the upper and lower surfaces of the tongue, characterized by the steps of:

forming the plurality of contacts from a single first carrier;

forming the shielding member from a second carrier to have two discrete shielding plates;

stacking the first carrier and the second carrier; and molding the plurality of contacts and the two discrete shielding plates with an insulator in one shot.

2. The method as claimed in claim 1, wherein the step of forming the plurality of contacts comprises forming a first group of only five contacts including the two outermost upper or lower contacts and a second group of only one contact.

3. The method as claimed in claim 1, wherein the step of forming the plurality of contacts comprises forming each contact thereof to have a front contacting portion, a securing portion, and a widened rear soldering portion wider than the front contacting portion, among which only the widened rear soldering portion is connected with a carrier strip of the single first carrier.

4. An electrical connector comprising:

an insulative housing having a tongue with an upper and lower surfaces;

a plurality of contacts having respective contacting portions exposed to the upper and lower surfaces of the tongue and having two outermost upper or lower contacts; and two discrete shielding plates situated between the upper and lower surfaces of the tongue and overlapping the two outermost upper or lower contacts along a vertical direction perpendicular to the upper and lower surfaces of the tongue; wherein the plurality of contacts are formed from a single first carrier, each of the plurality of contacts having a front contacting portion, a securing portion, and a widened rear soldering portion wider than the front contacting portion;

the two discrete shielding plates are formed from a second carrier; and the plurality of contacts and the two discrete shielding plates are molded together with the insulative housing in one shot.

5. The electrical connector as claimed in claim 4, wherein the plurality of contacts comprises a first group of only five contacts including the two outermost upper or lower contacts and a second group of only one contact.

* * * * *